United States Patent [19]

Carlson

[11] Patent Number: 4,499,998

[45] Date of Patent: Feb. 19, 1985

[54] FOOD CONTAINER WITH REMOVABLE LID

[75] Inventor: Arthur R. Carlson, East Malvern, Australia

[73] Assignee: Brian Davis and Company Proprietary Limited, Scoresby, Australia

[21] Appl. No.: 476,809

[22] Filed: Mar. 18, 1983

[30] Foreign Application Priority Data

Sep. 24, 1982 [AU] Australia ..... PF6048

[51] Int. Cl.[3] ..... B65D 43/00

[52] U.S. Cl. ..... 206/541; 62/371; 62/457; 220/22.3; 220/23; 220/284; 220/412

[58] Field of Search ..... 62/371, 372, 441, 447, 62/457; 150/55; 206/541-550; 220/23, 281, 284, 306, 324, 400, 408, 412, 22.3

[56] References Cited

U.S. PATENT DOCUMENTS

| | | | |
|---|---|---|---|
| 1,674,352 | 6/1928 | Adams | 220/22.3 |
| 2,457,043 | 12/1948 | Histand | 206/545 |
| 2,496,296 | 2/1950 | Lobl | 206/545 |
| 2,725,271 | 11/1955 | Cunningham | 62/447 |
| 2,780,385 | 2/1957 | Tupper | 150/55 |
| 2,999,611 | 9/1961 | Paulson | 220/306 |
| 3,255,607 | 6/1966 | Bair et al. | 62/372 |
| 3,498,494 | 3/1970 | Voorhees, Jr. | 220/400 |
| 3,556,339 | 1/1971 | Lind et al. | 150/55 |
| 3,836,044 | 9/1974 | Tilp et al. | 220/22.3 |
| 4,024,731 | 5/1977 | Branscum | 220/23 |
| 4,213,309 | 7/1980 | Pifer | 62/457 |

*Primary Examiner*—George E. Lowrance
*Assistant Examiner*—Jimmy G. Foster
*Attorney, Agent, or Firm*—Walter H. Schneider

[57] ABSTRACT

A food container having a peripheral rim with a recess to enable the lid of the container to be easily removed, a bottle adapted to be held in the container and a divider to divide the container into a number of distinct zones.

3 Claims, 6 Drawing Figures

FOOD CONTAINER WITH REMOVABLE LID

This invention relates to containers and refers particularly, although not exclusively, to containers for food or the like.

Containers for food and particularly such containers intended to be used as lunch boxes are very well known. However, known lunch boxes have inherent problems and difficulties which are well known to all who use them. It is therefore the principal object of the present invention to provide a container for food or the like which is relatively easily used.

With the above and other objects in mind, the present invention provides a container for food or the like comprising a base and a lid, said base having an open top and mutually perpendicular side walls extending in a plane transverse to the plane of said top, said side walls having an outwardly then downwardly projecting rim adjacent said top, said rim extending around said base at the one level and having a recessed portion at a junction of two of said side walls, said lid being adapted to releasably engage said side walls so as to cover said top and enclose said base, said recess being provided to enable said lid to be relatively easily removed; one of said lid or said base having means for releasably retaining a bottle in predetermined relation thereto.

In order that the invention may be more clearly understood and readily put into practical effect there shall now be described by way of non-limitative example only preferred constructions of containers incorporating the principal features of the present invention, the description being with reference to the accompanying illustrative drawings. In the drawings.

Figure 1:
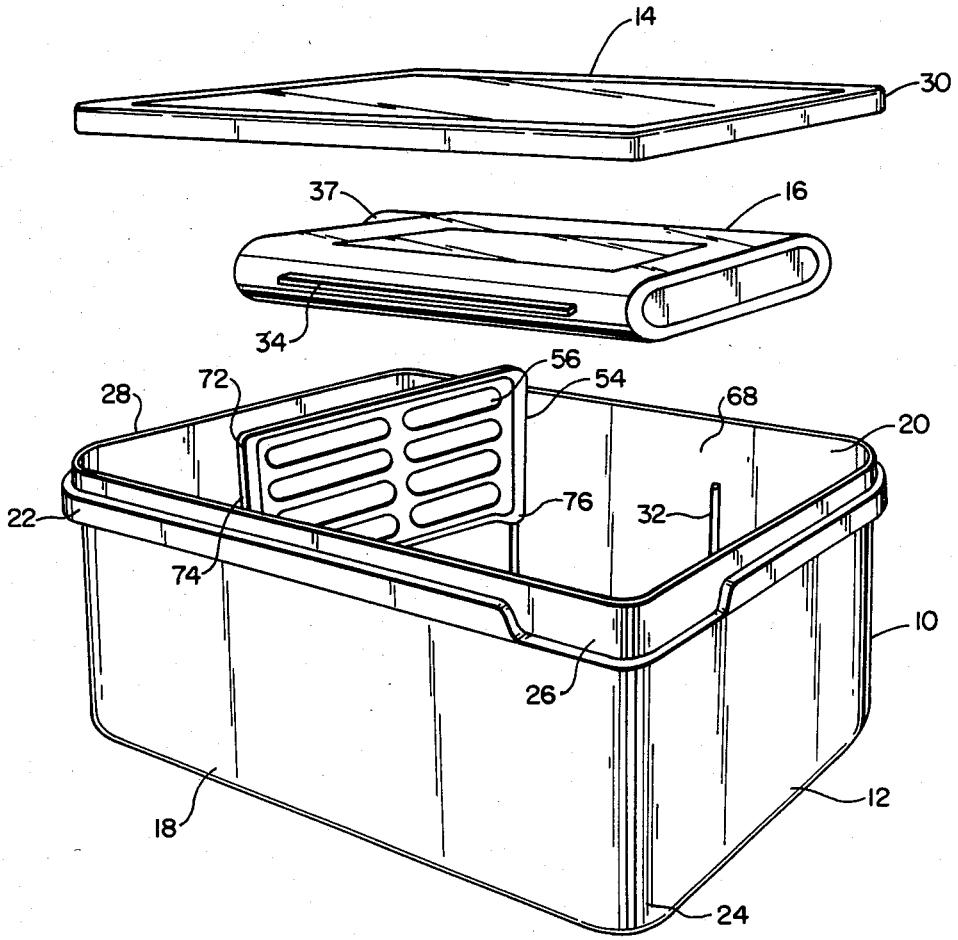
FIG. 1 is an exploded perspective view of a first embodiment of a container incorporating the principal features of the present invention.
Figure 2:
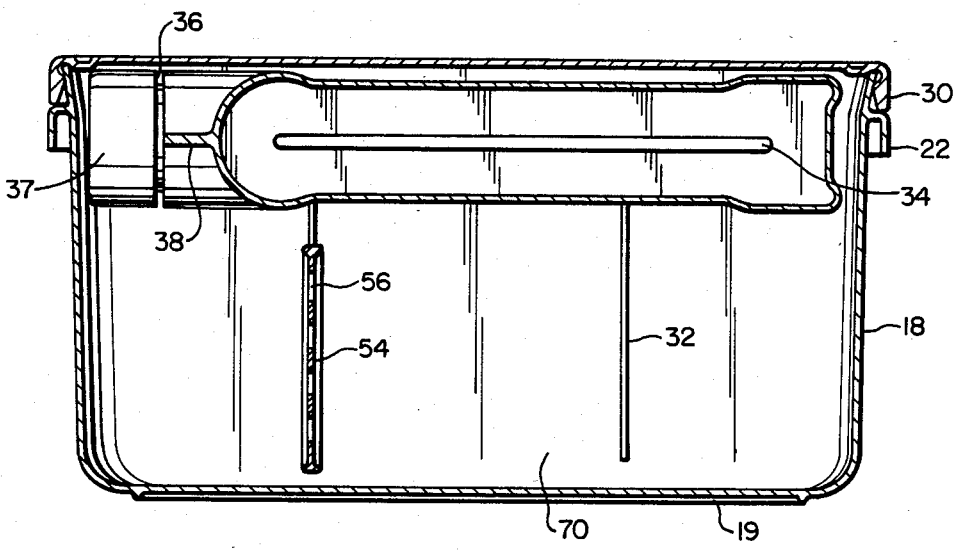
FIG. 2 is a vertical cross-section along the longitudinal axis of the container of FIG. 1.

To firstly refer to the container of FIGS. 1 and 2, there is shown a container 10 having a base 12, a lid 14, a bottle 16 and a divider 54.

The base 12 is generally rectangular and has four mutually perpendicular side walls 18 extending upwardly from a bottom surface 19. The top 20 of the base 12 is open and is adapted to be closed by the lid 14.

Adjacent the top 20 there is provided a rim 22 extending outwardly and downwardly of the side walls 18 adjacent the top 20. The rim 22 extends around the entire base 12 and is of constant dimension throughout except at corner 24. At corner 24 the rim has a recessed portion 26 which allows a user to place their finger(s) under the lid 14 to remove it from the base 12.

The lid 14 is of rectangular construction and is dimension so as to be a removable but sealing fit on the topmost portion 28 of the side walls 18 of base 12. The side skirt 30 of the lid 14 extends slightly over the side walls 18.

The inner surfaces 68 of two opposite or parallel side walls 18 have two outstanding and inwardly projecting lugs 32 which terminate below the top 28. The lugs 32 are adapted to support the bottle 16 by means of the two ribs 34 each extending outwardly from the side of the bottle 16. The bottle 16 is approximately rectangular although it is relatively thin. This enables the bottle 16 to rest on the lugs 32 without interfering with the lid 14 and the base 12. When in this position, a space 70 is created inside base 12 below the bottle 16 and above the bottom 19 in which food or the like can be stored. The bottle has an opening 36 which is adapted to be closed by a cap 37. A flange 38 is provided to hold the cap 37 when not in use.

The bottle 16 can easily be filled with any suitable fluid such as, for example, water or cordial. If desired, the duly filled bottle 16 can be placed in a refrigerator or freezer to enable the contents to be chilled or frozen. In this way, not only are the contents of the bottle 16 still cool after a period of time but also the food or the like stored in the base 12 under the bottle 16 is also kept relatively cool. This makes the container 10 very suitable for use as a lunch box, particularly by children or school children. The ease of removal of the lid 14 due to recess 26 and the ease of use of bottle 16 greatly facilitates their use.

The divider 54 is of generally planar construction and has a number of openings 56 therethrough to allow for a flow of air yet restrain solid objects from unwanted movement. The two ends 72 of divider 54 have a vertically extending groove 74 therein to enable the divider to be placed in base 12 with the lugs 32 being located in the grooves 74. In this way, the divider is accurately located. The divider 54 has downwardly extending projections 76 at each end so that the lowermost portion of the divider 54 does not contact the bottom 19 of base 12. The divider 54 can be placed in either set of lugs 32 if desired so as to divide the base 12 into two distinct zones for correct storage and cartage of the food or the like. If desired, two separate dividers may be used on the pairs of lugs 32. Alternatively, no divider can be used.

Figure 3:
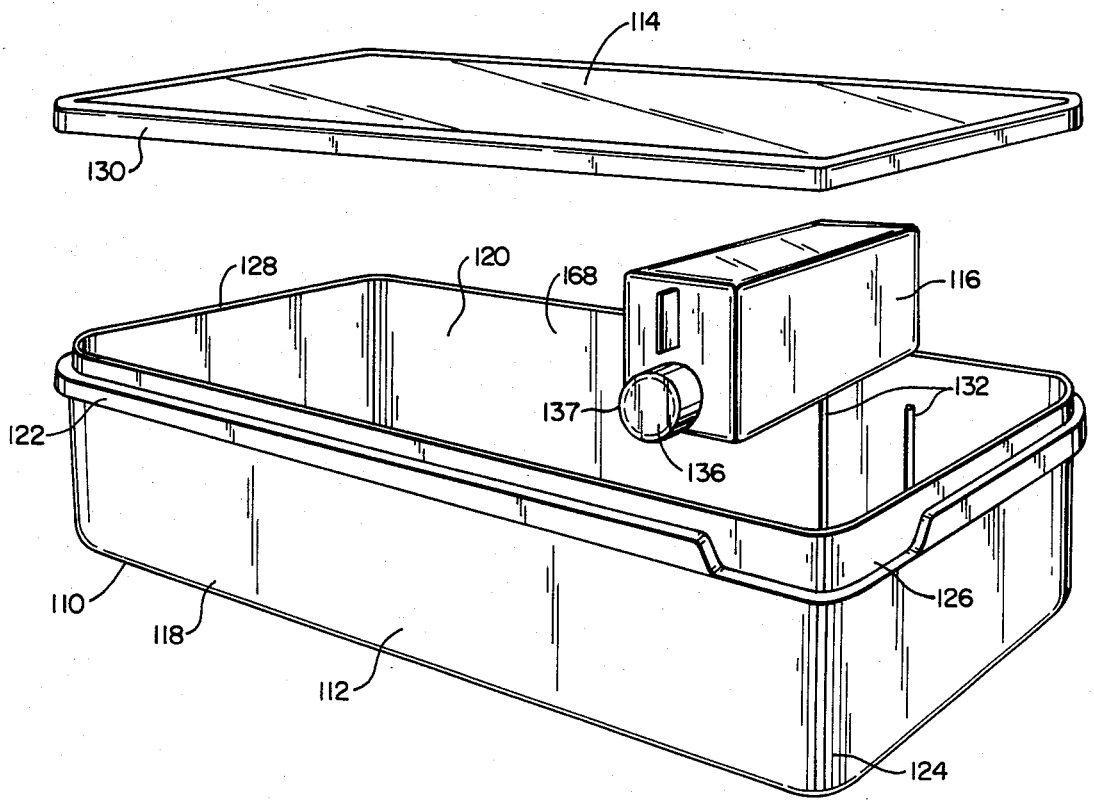
FIG. 3 is an exploded perspective view of a second embodiment of a container incorporating the principal features of the present invention.
Figure 4:
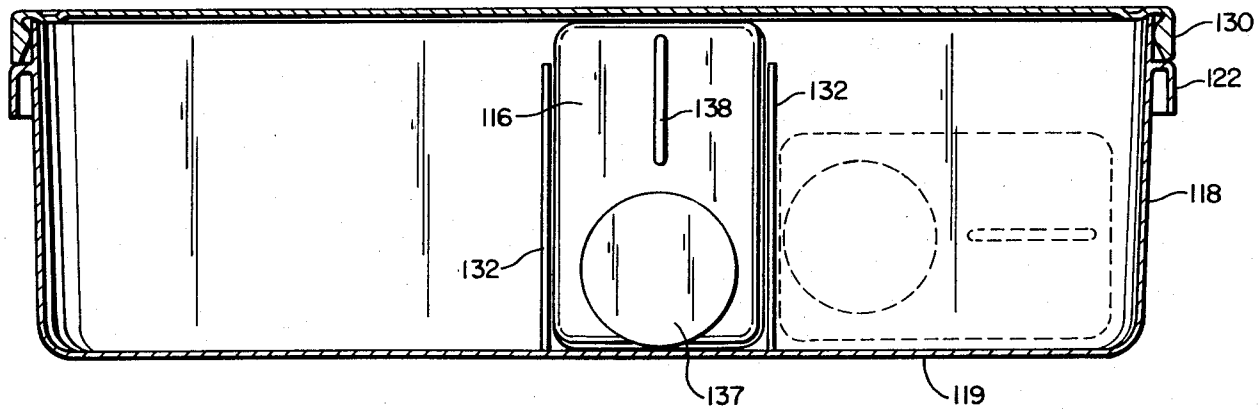
FIG. 4 is a vertical cross-section along the longitudinal axis of the embodiment of FIG. 3.

To refer now to the embodiment of FIGS. 3 and 4 there is shown a container 110 which has a base 112, a lid 114, and a bottle 116.

The base 112 is similar to the base 12 of FIGS. 1 and 2 in that it has four mutually perpendicular side walls 118 extending upwardly from a base 119, and an open top 120 adapted to be closed by the lid 114.

Adjacent the top 120 there is provided a rim 122 extending outwardly and downwardly of the side walls 118. As per the rim 22 of FIGS. 1 and 2, the rim 122 extends around the entire base 112 and is of constant dimensions throughout except at corner 124 where the rim 122 has a recessed portion 126 which allows a user to place their finger(s) under the lid 114 to remove it from the base 112. A second recess portion may be provided on the diagonally opposite corner for a similar purpose if so desired.

The lid 114 is of rectangular construction and is dimensioned so as to be a removable but sealing fit on the tops 128 of the side walls 118. The side skirt 130 of the lid 114 extends slightly over the side walls 118.

The inner surfaces 168 of two opposite or parallel side walls 118 have two upstanding and inwardly projecting lugs 132 which terminate below the tops 128 of side walls 118. The lugs 132 are adapted to retain in position the bottle 116 as the distance between the lugs 132 is dimensioned to be fractionally greater than the width of the bottle 116. The bottle 116 is approximately rectangular in cross-section and is sized to be a neat fit in the base 112 of container 110. The height of the bottle 116 is approximately equal to the distance between the opposite side walls 118 containing the lugs 132. Also, the bottle is dimensioned so as to be approximately equal to, although slightly less than, the distance between the bottom 119 and the underneath surface of the lid 114 when the lid is in position. When in position in the base 112 the bottle 116 effectively acts as a divider to separate the base 112 into three distinct zones. Alternatively, the bottle 116 can be laid on its side at one end where it will be retained in position by the lug 132 and the end wall of the base 112. This is as shown in relief on FIG. 4. Like the bottle 16 of FIGS. 1 and 2, the bottle 116 has an opening 136 which is adapted to be closed by a cap 137. A flange 138 is provided on the bottle to hold the cap 137 when not in use.

The bottle 116 can easily be filled with any suitable fluid such as, for example, water or cordial. If desired, the duly filled bottle 116 can be placed in a refrigerator or freezer to enable the contents to be chilled or frozen. In this way, not only are the contents of the bottle 116 still cool after a period of time, but also the food or the like stored in the base 112 near the bottle 116 is also kept cool. This makes the container 110 very suitable for use as a lunch box, particularly by children or school children. The ease of removal of the lid 114 due to recess 126 and the ease of use of bottle 116 greatly facilitates its use.

If desired, the bottle 116 may not be used. Furthermore, if desired, in place of the bottle 116 there could be used the standard sized drink carton sold under the trade mark "TETRA PAK". These particular containers are well known and a number of various forms of drinks including milk, milk-based drinks and fruit juices and fruit juice drinks are sold in such containers. They can easily be chilled or frozen and used in place of the bottle 116.

Figure 5:
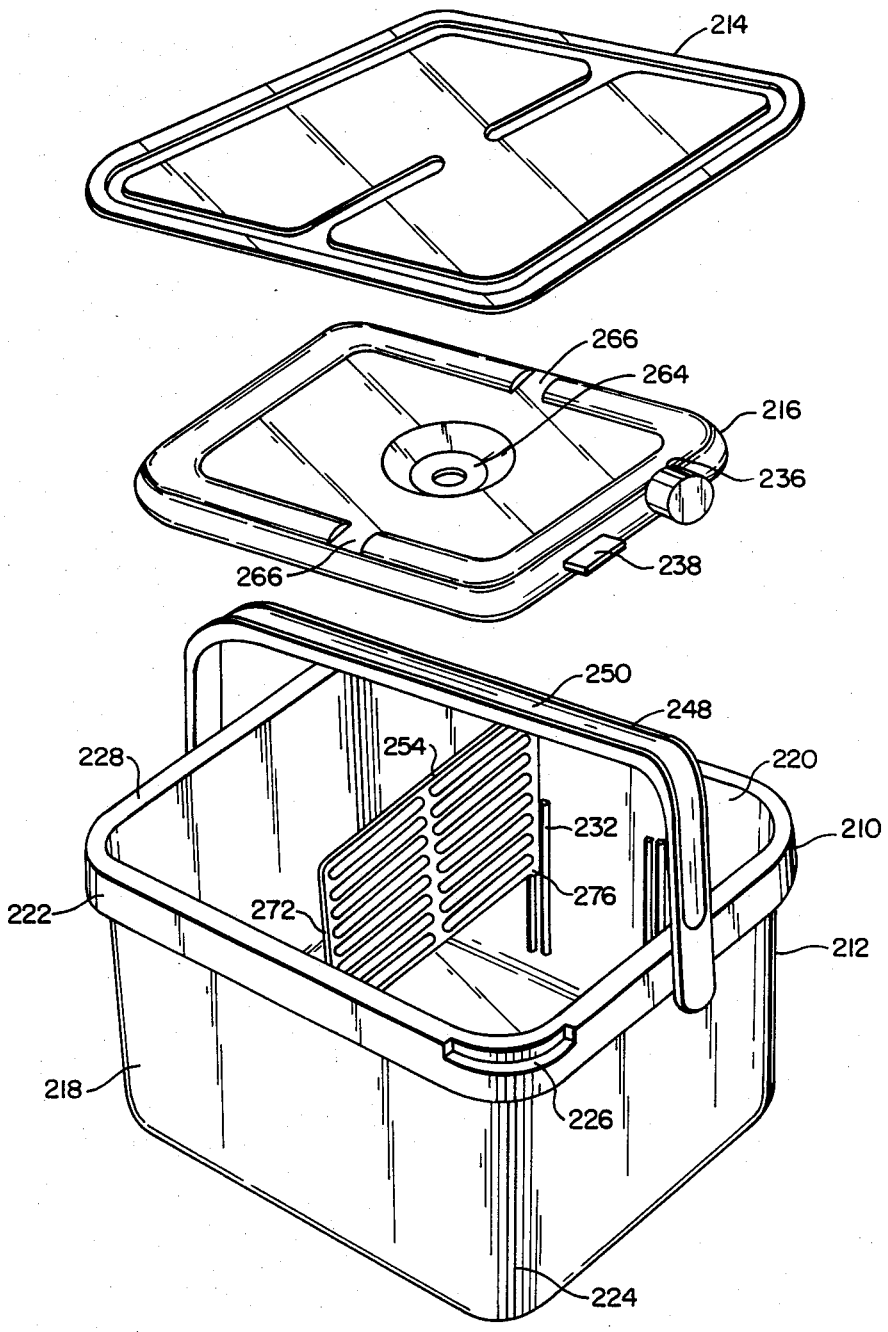
FIG. 5 is an exploded perspective view of a third embodiment of a container incorporating the principal features of the present invention.
Figure 6:
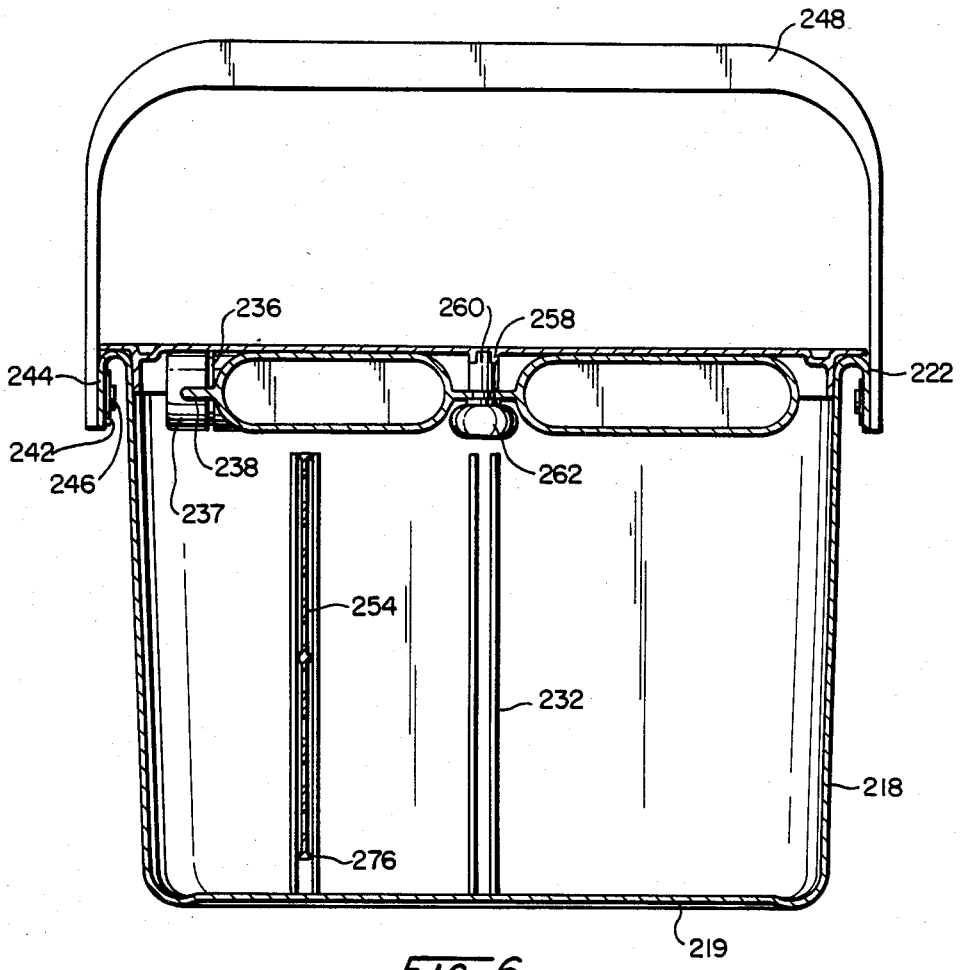
FIG. 6 is a verticall cross-section along the longitudinal axis of the embodiment of FIG. 5.

To turn now to the embodiment of FIGS. 5 and 6, there is shown a container 210 which has a base 212, a lid 214 and a bottle 216.

The base 212 is similar to the base 12 of FIGS. 1 and 2 in that it has four mutually perpendicular side walls 218 extending upwardly from a bottom 219 and an open top 220 adapted to be closed by the lid 214.

Adjacent the top 220 there is provided a rim 222 extending outwardly and downwardly of the side walls 218. As per the rim 22 of FIGS. 1 and 2, the rim 222 extends around the entire base 212 and is of constant dimensions throughout except at corner 224 where the rim 222 has a recessed portion 226 which allows a user to place their finger(s) under the lid 214 to remove it from the base 212. A second recess portion may be provided on the diagonally opposite corner for a similar purpose if so desired.

At each end, the rim 222 has depending therefrom a flange 242 each having a hole 244. The holes 244 are adapted to receive the pins 246 of handle 248 which is capable of carrying the loaded container 210. The handle 248 has a grooved upper portion 250 to facilitate its operation and to increase its strength.

The two opposite or parallel side walls 218 of the base 212 have two parallel sets of lugs 232 which are adapted to releasably receive a divider 254. The divider can be placed in operative relationship with either set of lugs 232 if desired to divide the base 212 into a number of distinct zones for correct storage and cartage of the food or the like to be placed therein. The divider 254 is of generally planar construction and has a number of openings 256 therethrough to allow for a flow of air yet to restrain solid objects from unwanted movement. The ends 272 of divider 254 are received between each pair of lugs 232 to engage therein. Furthermore, the lowermost portions of the ends 272 have projections 276 to prevent the lowermost portions of the divider 254 from contacting the bottom 219 of base 212.

The lid 214 may operate in the same manner as the lid 14 of FIGS. 1 and 2 or, alternatively, instead of fitting outside the side walls 218 of base 212 it may achieve fitment by fitting inside the walls 218 of base 212 and rest upon the topmost portions 228 of the side walls 218. Such a fitting can be by an interference fit, or, if desired, by external clips or other holding devices. The form as shown in FIGS. 5 and 6 is that whereby an interference fit is used.

In the embodiment shown, the lid 214 has on its underside a central transverse flange 258 having a central blind hole 260. The blind hole 260 is designed to receive a bolt 262 which releasably secures bottle 216 to the underside of lid 214.

Bottle 216 is similar to the bottle 16 of FIGS. 1 and 2 except that it has a recessed central hole 264 to receive bolt 262 to clamp the bottle 216 to the underside of lid 214. Recesses 266 are provided on either side of the bottle 216 to allow the flange 258 to pass therethrough and thus for the bottle 216 to be a snug fit underneath the lid 214. The bottle 216 has an opening 236 and a flange 238 which operates in exactly the same way as opening 36 and flange 38 of FIGS. 1 and 2. Cap 237 is provided as well.

Bottle 216 can be used in the same manner as bottle 16 of FIGS. 1 and 2 or bottle 116 of FIGS. 3 and 4. Therefore, with the bottle 216 in position under lid 214 and the lid 214 positioned in or on base 212, the base 212 can contain food or the like which may be kept cool by the frozen or chilled contents of the bottle 216. The divider 254, if used, allows different products to be stored in separate and distinct zones.

The bottles 16, 116 and 216 can be used to hold frozen or chilled liquids, or even liquids at room temperature. The respective containers 10, 110 and 210 may even be used without the bottles. If desired, the bottles can be filled with special refrigerant liquids as an alternative to the consumable liquids mentioned. Furthermore, all containers can be used with or without their respective dividers.

All parts may be made of any suitable material such as, for example, a plastics material.

Whilst there has been described in the foregoing description preferred constructions of containers incorporating the principal features of the present invention, it will be understood by those in the particular technical field that many variations or modifications in details of design or constructions may be made without departing from the essential nature of the present invention, the scope of which is to be determined from the following claims.

I claim:

1. A container for food or the like comprising a base formed by a bottom wall and four perpendicular side walls of equal height joined to the bottom wall and to each other thereby creating an open-top enclosure; a rectangularly-shaped rim of constant height and width extending completely around the outer surfaces of said side walls at a line adjacent to but slightly below the top of said enclosure; at least one recess in said rim adjacent a junction of two side walls, said recess comprising a cut-away section of a substantial portion of the height of said rim extending from its top downwardly and extending from a point adjacent each side wall through the junction thereof; a detachable, flat lid having top and bottom surfaces; a rectangularly-shaped lip corresponding in width to the width of said rim extending downwardly from said bottom surface of said lid a distance equivalent to the distance at which the top of said rim is below the top of said enclosure, the bottom of said lip engaging the top of said rim except at the location of said recess when said lid is positioned on said base; at least one pair of inwardly projecting elongated lugs positioned on the inner surfaces of opposite side walls extending from points near the junctions of said side walls with said base upwardly towards the top of said enclosure, each of said lugs being provided with a slot extending substantially along its length; and a flat rectangularly-shaped divider detachably secured by two of its edges positioned in said slots thereby dividing said enclosure into horizontally disposed zones.

2. A container according to claim 1 in which at least two pairs of elongated lugs are positioned on the inner surfaces of the same opposite side walls, said lugs being further provided with means at their top edges for detachably securing a bottle.

3. A container according to claim 1 in which said lid is provided on its bottom surface with means for detachably securing a bottle.

* * * * *